US006299059B1

(12) United States Patent
Bernstein

(10) Patent No.: US 6,299,059 B1
(45) Date of Patent: Oct. 9, 2001

(54) MECHANICAL LOCK FOR PAPER CARTON

(75) Inventor: Linda A. Bernstein, Maineville, OH (US)

(73) Assignee: International Paper Co., Stamford, CT (US)

( * ) Notice: Subject to any disclaimer, the term of this patent is extended or adjusted under 35 U.S.C. 154(b) by 0 days.

(21) Appl. No.: 09/764,255

(22) Filed: Jan. 19, 2001

Related U.S. Application Data

(60) Provisional application No. 60/178,053, filed on Jan. 24, 2000.

(51) Int. Cl.[7] ..... B65D 45/00
(52) U.S. Cl. ..... 229/115; 229/125.28; 229/902
(58) Field of Search ..... 229/115, 125.28, 229/149, 902, 906

(56) References Cited

U.S. PATENT DOCUMENTS

| | | | | |
|---|---|---|---|---|
| 896,600 | | 8/1908 | Thornton . | |
| 2,120,470 | | 6/1938 | Patterson . | |
| 3,306,520 | * | 2/1967 | Allard | 229/149 |
| 3,623,650 | | 11/1971 | Watts . | |
| 3,656,611 | | 4/1972 | Mertz . | |
| 3,744,707 | | 7/1973 | Ross . | |
| 3,756,497 | | 9/1973 | Stewart . | |
| 3,758,017 | | 9/1973 | Ross . | |
| 3,931,926 | | 1/1976 | Bensen . | |
| 4,362,266 | * | 12/1982 | Webinger | 229/149 |
| 5,009,366 | | 4/1991 | Druff . | |
| 5,058,803 | | 10/1991 | Gulliver . | |
| 5,118,033 | * | 6/1992 | Kula | 229/115 |
| 5,299,734 | | 4/1994 | Lane . | |
| 5,431,333 | * | 7/1995 | Lorenz | 229/149 |
| 5,535,940 | | 7/1996 | Olds . | |
| 5,544,806 | | 8/1996 | Anderson . | |
| 5,788,145 | * | 8/1998 | Grahahm et al. | 229/115 |
| 5,950,912 | | 9/1999 | Economopoulos . | |
| 6,092,719 | * | 7/2000 | Capo | 229/125.28 |
| 6,158,652 | | 12/2000 | Ruiz . | |

* cited by examiner

*Primary Examiner*—Gary E. Elkins
(74) *Attorney, Agent, or Firm*—Christopher Nicastri

(57) ABSTRACT

A triangular paperboard container for fast foods, particularly pizza slices, is fashioned from two triangular tray halves. The upper tray half is provided with a plurality of manually actuable over center toggle locking tabs which are pushed down and pass between opposed tips of respective notches. The notches are spaced along the upper edges of the bottom tray half side walls. When pushed downwardly, each toggle locking tab engages and distorts opposed points at the entrance to each notch, the opposed points resuming their original position after the tab has passed them, by virtue of the inherent resiliency of paperboard. The locking tabs themselves also distort somewhat when pushing them down. Each notch includes oppositely sloping edges against which opposite sides of a corresponding toggle locking tab engage.

5 Claims, 3 Drawing Sheets

MECHANICAL LOCK FOR PAPER CARTON

This application claims the benefit of provisional application Ser. No. 60/178,053 filed Jan. 24, 2000.

BACKGROUND

In the fast food industry, trays having tapered sides are recurring packaging shapes. Also sometimes termed boats, they are widely used in the industry. They frequently hold uncovered food products and there is generally no provision made for covering the tray. However, it is not uncommon to find this type of package having an integral tuck top lid for a cover. Often, a second boat or tray is turned upside down and used as a cover for the base or lower tray which holds the food product. A variety of mechanical locks and other means has been developed to unite the base tray and lid or upper tray, thereby locking them together for delivery of the food item.

It is a general requirement of the industry that any packaging for fast food delivery be simple and easy to use so as to make speedy the meal service.

BRIEF DESCRIPTION OF THE INVENTION

A two piece container includes a mechanical locking tab and groove or notch arrangement that enables the rapid joining of two tapered trays each having upstanding side walls. Each tray is of triangular shape suitable for packaging a slice of pizza. The purpose of the tray and locking construction is to quickly and effectively join two tray halves thereby forming a fast food package. In general, the walls which are joined by the locks are tray side walls which extend from parallel top and bottom tray central sections. The upper tray telescopes onto the lower tray, with the side walls of the two trays being in at least partial surface to surface contact. The upper or cover tray sidewalls carry over center toggle tabs which are manually pushed down to engage certain slanting edges of respective notches on the lower tray sidewalls.

DETAILED DESCRIPTION OF THE INVENTION

Figure 1:
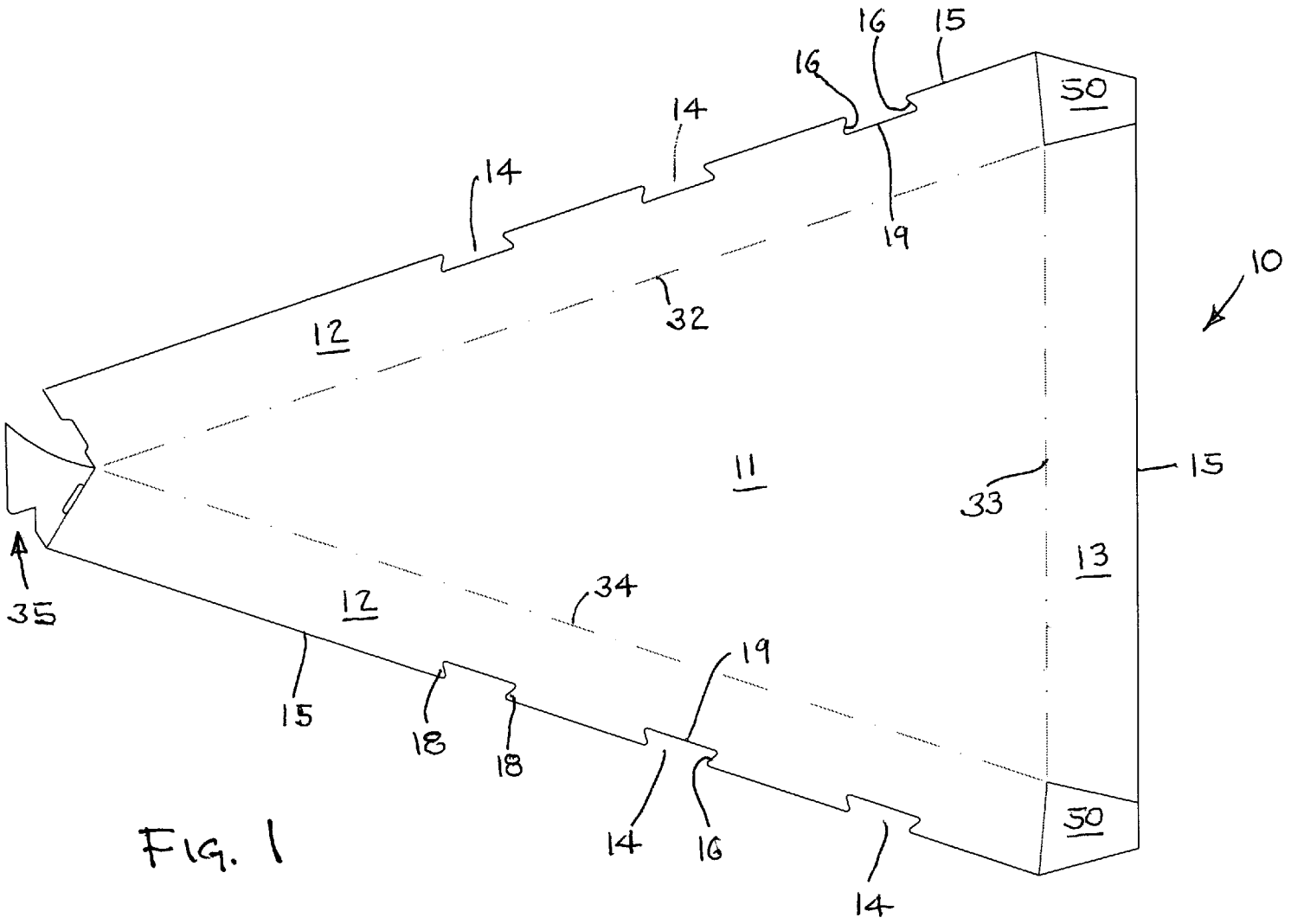
FIG. 1 is a plan view of a unitary blank for forming the triangular base or bottom tray of the container, the blank being typically formed of paperboard or other foldable, stiff, and resilient sheet material.

Referring now to FIG. 1, the base tray is denoted as 10 and is formed from a unitary blank of paperboard, the blank having a central area 11 and having two side walls or strips 12 of equal length and width, and a base or third side wall 13 also of the same width as 12. Strips 12 are generally bent ninety degrees or less, in the same direction, about fold or crease lines 32 and 34, with strip 13 also formed by bending ninety degrees or less about fold line 33. A conventional joint denoted as 35 is located at the apex of the triangular base or bottom to hold the tips of strips 12 together. Glue flaps 50 are foldably attached to the base ends of each of strips 12, and are glued to adjacent ends of strip 13 after bending, for erection of the tray from the blank.

The outer edges 15, also termed free edges, of strips 12 (and strip 13) are each provided with a plurality of relatively shallow spaced apart notches 14 which border edges or rims 15. Each notch 14 has a base 19 and two slanting surfaces or edges 16, slanting towards each other as they approach the free edges 15 of the strips. Notch tips 18 are located at the intersection of free edges 15 and slanting surfaces 16, with the tip 18 separation denoted as 42. See FIG. 4. The angle between any notch edge 16 and any free edge 15 is acute. The notches are typically die cut, as may be the whole blank. The tip separation or width 42 is the entrance for each notch, this width being less than the length of the notch bases or bottoms 19.

Figure 2:
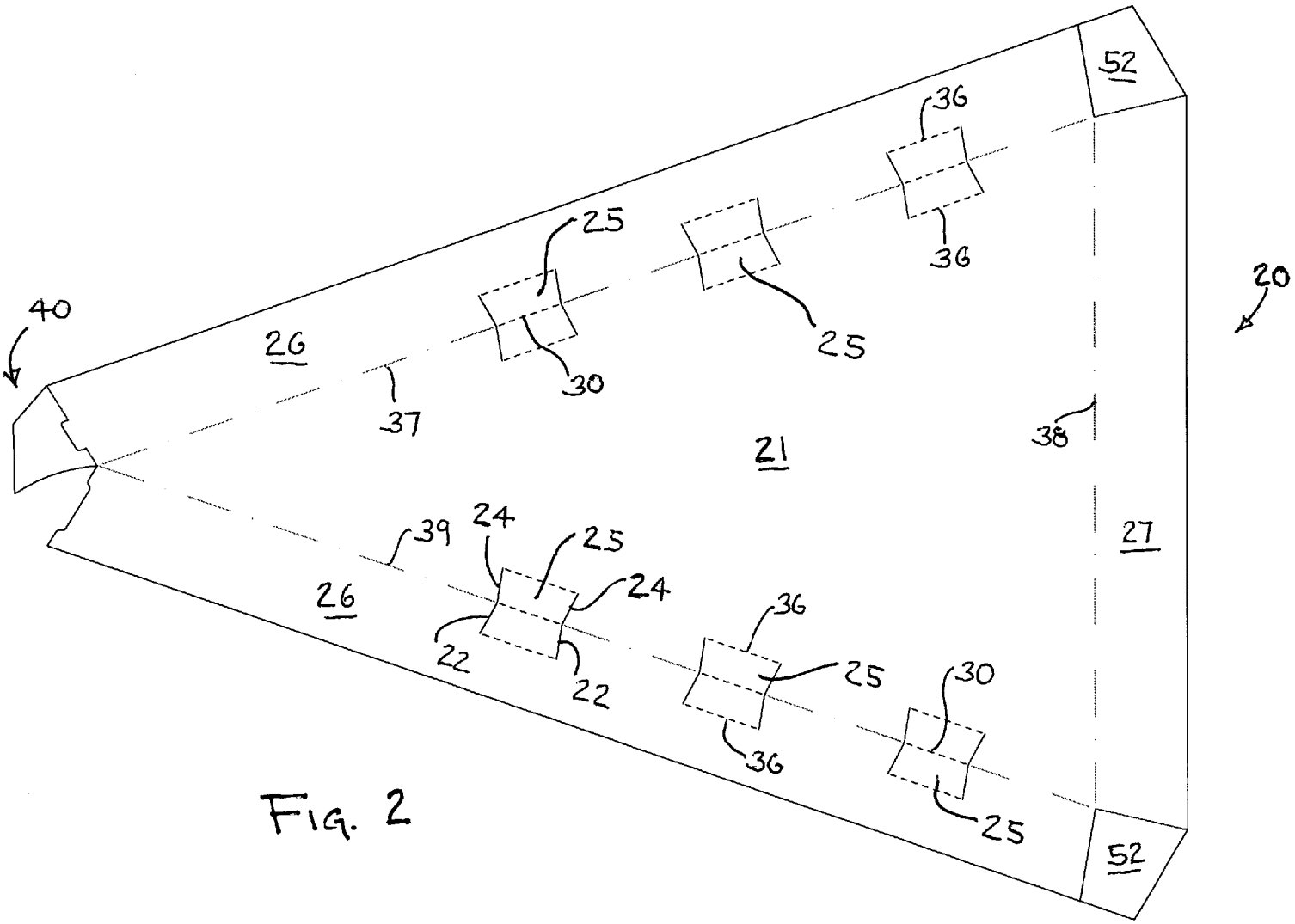
FIG. 2 is plan view of a unitary blank for forming the triangular top or cover tray of the container, the blank also being typically formed of paperboard or other foldable, stiff, and resilient sheet material.

Referring now to FIG. 2, another unitary triangular paperboard blank is shown, here for forming a top tray 20 and having a central portion 21. The tray is provided with two side walls or strips 26 of equal length and width, and an end or base strip 27, of the same width as 26. These strips are bent ninety degrees or less about fold lines 37, 38, and 39 to form a triangular lid or top tray having downwardly depending sides defined by strips 26 and 27.

A plurality of cuts 22 and 24, pairwise arranged, define over center toggle action tabs or locks 25. The sides of each tab 25 are defined by cuts 22 and 24. Each lock has a central fold line 30 which is collinear with a respective fold line 37, 39. Each tab 25 also has an outer fold or score line 36 at each of its ends. Fold lines 30 and 36 are parallel to each other, while cut lines 22 and 24 meet at a slight angle (being nearly collinear) and are generally orthogonal to the three parallel fold lines 36 and 30. The over center tabs or locks 25 just described are similar to indicia tabs denoted as 100 at FIGS. 2, 3, and 4 of U.S. Pat. No. 5,058,803 issued to Robert F. Gulliver and incorporated herein by reference. It is seen that their toggle action depends on the resiliency and bendability of the sheet material.

Glue tabs 52 are foldably carried by the ends of strip or side wall 27, and are adapted to be glued to a respective end of a strip 26 when the blank is erected by bending and glueing to form a lid. The ends of strips 26 are held together at the apex of the triangular tray by a conventional joint 40.

Figure 3:
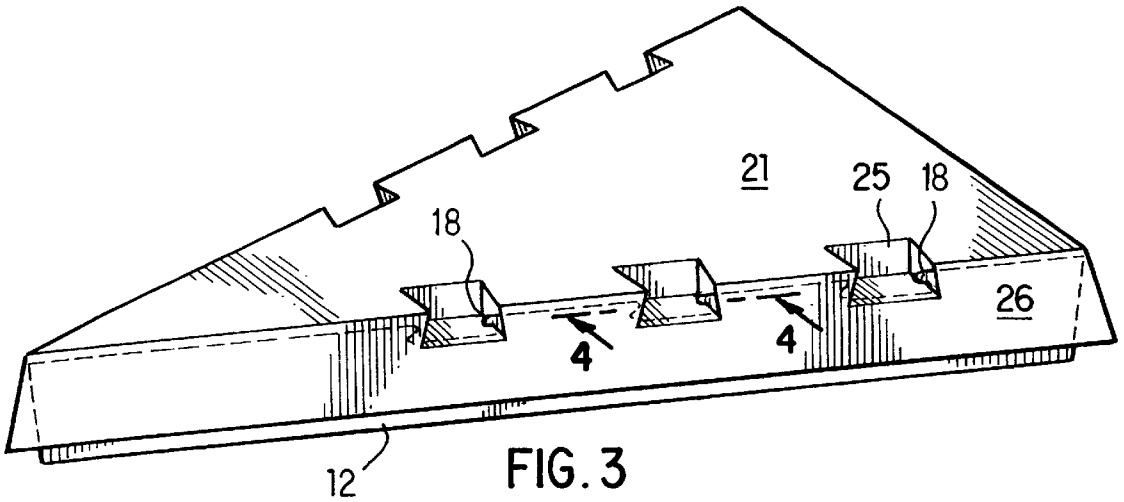
FIG. 3 is a perspective view of the container, partially in phantom lines, formed by joining the two erected blanks of FIGS. 1 and 2.
Figure 4:
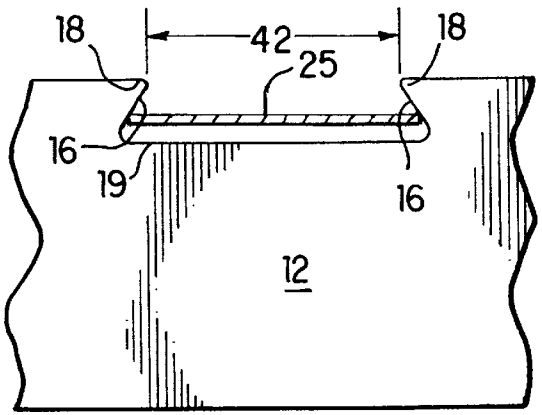
FIG. 4 is a view taken along section 4—4 of FIG. 3.

In operation, the erected base tray is filled with a food product, such as a triangular pizza slice. The erected lid or top tray is placed over the base, with the base side walls 12 and lid side walls 26 being in at least partial surface to surface contact, and locking tabs 25 on the lid over substantially aligned with respective notches 14 of the base. The upper tray telescopingly receives the lower tray. The top locks or tabs 25 are substantially vertically aligned with the bottom tray notches 14. Tabs 25 are now individually pushed down, as by a finger tip, so that tabs 25 slightly engage, distort, and pass by the tips 18 at the entrance to each notch. By making the width of each tab, particularly at or near its central fold line 30, slightly larger than the width 42 of each notch (the distance between opposed notch points 18), each tab is held in its respective notch to inhibit lid loss. Opposite side or free edges of the locking tabs 25 abut slanted notch edges or sides 16, and thus resist any upward movement of the lid or top tray away from the base tray. This relation is shown in FIG. 4, where section 4—4 of FIG. 3 is taken between the parallel sides 26 and 12 (those two nearest the reader) of the upper and lower tray halves respectively. In FIG. 3, the outline of the notched upper edge of a lower side wall 12 is indicated by phantom lines, and tips 18 are shown as overlying bent down locking tabs 25. FIG. 4 shows the engagement of the side or edges of locking tabs 25 on slanted edges 16 of a notch. FIG. 3 also shows, with the phantom lines, a slight outward taper of the side walls of both the lower and the upper trays. This taper permits stacking of the top trays and the bottom trays (after their erection from the blanks) in separate stacks.

By the container design herein described, no additional paperboard is required to create a mechanism for joining the two tray halves, as is the case with some mechanical locking features of the prior art.

The shape of the trays to be joined may vary so long as corresponding notches on the base side walls and the tab toggle locks on the lid are aligned when the lid is placed upon the base. The two congruent lid and base halves may thus be rectangular, circular, oval, or polygonal, as well as triangular as here described.

As shown at FIG. 2, The tabs of each lock are substantially rectangular by virtue of being bordered by parallel fold lines 36 and substantially straight cuts 22 and 24, the latter defining side or free edges of a tab 25.

While two of the three sides of the base and lid have been shown as provided with locking tabs, only a single tab on one side wall may be employed. Thus, in FIG. 2, one locking tab may be employed on base strip 27, and no locking tabs on the other two strips 26. Alternatively, each side wall may be provided with the notch and locking tab construction of this invention. Glue tabs 35 of FIGS. 1 and 40 of FIG. 2 are conventional and serve to hold the pointed ends of the two triangular trays together after glue is applied to them and set.

What is claimed is:

1. A paperboard container adapted for packaging fast food products, said container including a bottom half and a top half, said bottom half having a central base and at least one peripheral side wall upstanding from said base, said bottom half side wall having an upper rim, said upper rim having a notch bordering on said rim, said notch including a slanting edge which slants upwardly towards said rim to form an acute angle with said rim, said container top half having a central portion and at least one downwardly extending peripheral wall at an angle to said central portion, whereby a fold line is defined between said downwardly extending peripheral wall and said central portion, an over center toggle action tab spanning said fold line, said toggle tab extending into said notch and engaging said notch slanting edge, whereby said top and bottom halves form an easily assembled container for a food product.

2. The container of claim 1 wherein said over center toggle action tab is substantially rectangular.

3. The container of claim 1 wherein said container is generally triangular in form.

4. The container of claim 1 wherein said tab is generally rectangular, and wherein said notch has two said slanting edges, each of said slanting edges making an acute angle with said rim, and wherein said tab has two opposite edges each of which engages a respective said slanting notch edge.

5. A paperboard container adapted for packaging fast food products, said container including a bottom half and a top half, said bottom half having a central base and at least one peripheral side wall upstanding from said base, said bottom half side wall having an upper rim, said upper rim having at least one notch bordering on said rim, said notch including opposite edges both of which slant upwardly towards said rim and towards each other to thereby define a pair of opposite abutment points for said notch, the distance between said abutment points for each said notch defining a notch width, said container top half having a central portion and at least one downwardly extending peripheral wall at an angle to said central portion, whereby a fold line is defined between said downwardly extending peripheral wall and said central portion, at least one over center toggle action tab spanning said fold line, said toggle tab having a width, said tab width being greater than said notch width, said tab extending downwardly into said notch and engaged by said opposite slanting sides of said notch, whereby said top and bottom halves form an easily assembled container for a food product.

* * * * *